US009820026B2

(12) United States Patent
Akino

(10) Patent No.: US 9,820,026 B2
(45) Date of Patent: Nov. 14, 2017

(54) MICROPHONE

(71) Applicant: Hiroshi Akino, Kanagawa (JP)

(72) Inventor: Hiroshi Akino, Kanagawa (JP)

(73) Assignee: Audio-Technica Corporation, Tokyo (JP)

( * ) Notice: Subject to any disclaimer, the term of this patent is extended or adjusted under 35 U.S.C. 154(b) by 0 days.

(21) Appl. No.: 15/348,394

(22) Filed: Nov. 10, 2016

(65) Prior Publication Data

US 2017/0195764 A1 Jul. 6, 2017

(30) Foreign Application Priority Data

Jan. 6, 2016 (JP) ..... 2016-001265
Oct. 20, 2016 (JP) ..... 2016-206097

(51) Int. Cl.

| | |
|---|---|
| ***H04R 3/00*** | (2006.01) |
| ***H04R 1/08*** | (2006.01) |
| ***H04R 1/32*** | (2006.01) |
| ***H04R 19/04*** | (2006.01) |
| *H04R 9/02* | (2006.01) |

(52) U.S. Cl.
CPC ..... *H04R 1/083* (2013.01); *H04R 1/326* (2013.01); *H04R 19/04* (2013.01); *H04R 9/02* (2013.01)

(58) Field of Classification Search
CPC ..... H04R 1/083; H04R 1/326; H04R 9/025; H04R 9/048; H04R 19/04
USPC ... 381/92, 122, 174, 176, 313, 359, 365, 96, 381/356–358, 399, 408, 431
See application file for complete search history.

(56) References Cited

U.S. PATENT DOCUMENTS

2009/0238392 A1* 9/2009 Akino ..... H04R 1/2807 381/360
2011/0188680 A1* 8/2011 Akino ..... H04R 9/048 381/176
2013/0287223 A1* 10/2013 Akino ..... H04R 3/00 381/92
2014/0369507 A1* 12/2014 Akino ..... H04R 5/027 381/26

FOREIGN PATENT DOCUMENTS

JP 2015-5861 A 1/2015

* cited by examiner

*Primary Examiner* — Quynh Nguyen
(74) *Attorney, Agent, or Firm* — Whitham, Curtis & Cook, P.C.

(57) ABSTRACT

Provided is a unidirectional microphone including ribbon diaphragms which is reduced in dimensions. The microphone includes a bidirectional ribbon microphone unit and an omnidirectional condenser microphone unit. The ribbon microphone unit includes a pair of ribbon diaphragms. The condenser microphone unit is disposed between the pair of ribbon diaphragms.

5 Claims, 7 Drawing Sheets

MICROPHONE

TECHNICAL FIELD

The present invention relates to microphones.

BACKGROUND ART

A ribbon microphone, which is one type of microphone, includes a pair of magnets forming a magnetic field and a pair of ribbon diaphragms configured to vibrate in response to acoustic waves. The pair of ribbon diaphragms are disposed in the magnetic field. When the pair of ribbon diaphragms receive the acoustic waves, the pair of ribbon diaphragms vibrate in the magnetic field and generate electrical signals corresponding to the acoustic waves.

The typical ribbon microphones have bidirectivity. Microphones for collection of musical sounds or amplification of sound preferably have unidirectivity.

Unidirectivity of ribbon microphones is established through addition of a bidirectional component and an omnidirectional component. The unidirectivity of a ribbon microphone is established with a built-in acoustic tube in the ribbon microphone. Ribbon diaphragms have a small mass and a low mechanical impedance compared to those of diaphragms of other types of microphones, such as a dynamic microphone. The acoustic tube should have a large length to vibrate the ribbon diaphragms at low frequencies. That is, a unidirectional ribbon microphone requires a long acoustic tube. Thus, a reduction in dimensions of the unidirectional ribbon microphone is difficult.

With respect to techniques for reducing dimensions of a unidirectional ribbon microphone, techniques have been proposed to include a unidirectivity converter in place of an acoustic tube (for example, refer to Japanese Unexamined Patent Application Publication No. 2015-5861).

SUMMARY OF INVENTION

Technical Problem

The unidirectional ribbon microphone disclosed in Japanese Unexamined Patent Application Publication No. 2015-5861 includes a unidirectivity converter to establish unidirectivity. Thus, the reduction in dimensions of the microphone including ribbon diaphragms is insufficient.

An object of the present invention is to solve the problems described above and to reduce the dimensions of a unidirectional microphone including ribbon diaphragms.

Solution to Problem

The microphone according to the present invention includes a bidirectional ribbon microphone unit and an omnidirectional condenser microphone unit. The ribbon microphone unit includes a pair of ribbon diaphragms. The condenser microphone unit is disposed between the pair of the ribbon diaphragms.

According to the present invention, the dimensions of a unidirectional microphone including ribbon diaphragms can be reduced.

DESCRIPTION OF EMBODIMENTS

Microphone

Embodiments of a microphone according to the present invention will now be described with reference to the attached drawings.

Configuration of Microphone

Figure 1:
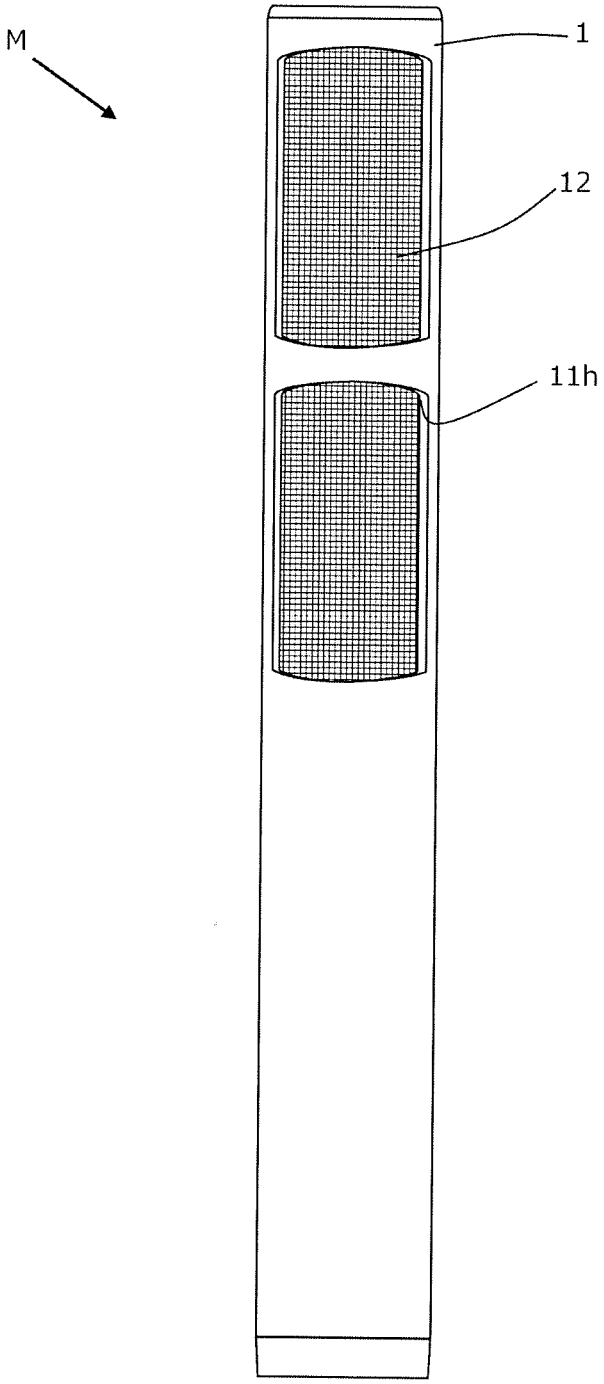
FIG. 1 is a front view of an embodiment of a microphone according to the present invention.

FIG. 1 is a front view of a microphone according to an embodiment of the present invention.

Figure 2:
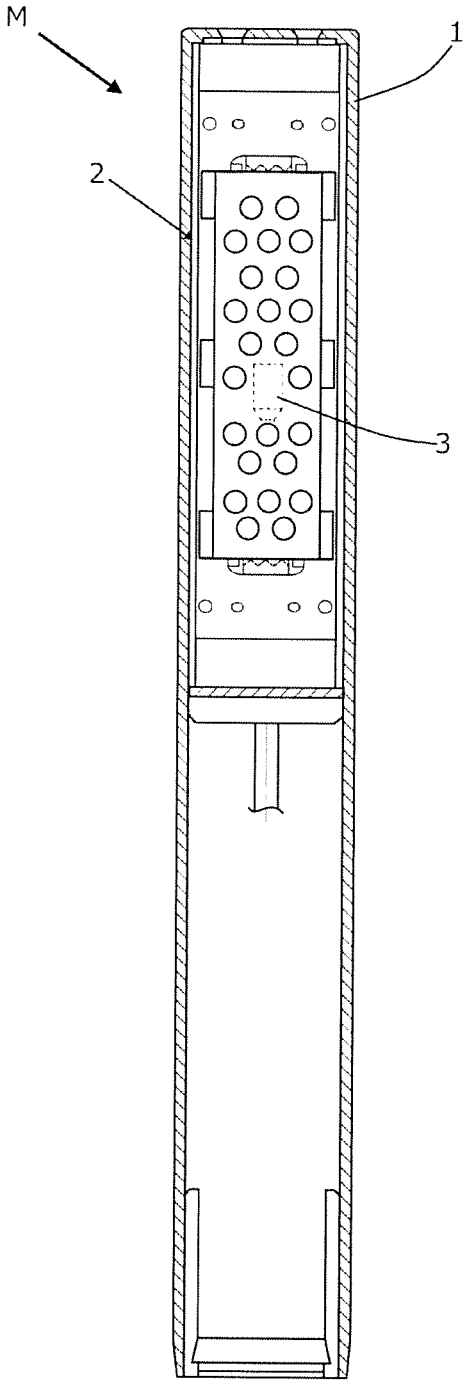
FIG. 2 is a cross-sectional front view of the microphone in FIG. 1.

FIG. 2 is a cross-sectional front view of the microphone in FIG. 1.

A microphone M collects acoustic waves from a sound source and outputs electrical signals corresponding to the acoustic waves. The microphone M includes a microphone case 1, a ribbon microphone unit 2, and a condenser microphone unit 3.

In the description below, the front of the microphone M is the direction (the forward direction of FIG. 1) of the microphone M directed to the sound source during sound collection. The rear of the microphone M is the direction (the backward direction of FIG. 1) is the direction opposite to the front of the microphone M. The upper side of the microphone M is the direction (the upper side in FIG. 1) to which one longitudinal end of the microphone M is directed. The lower side of the microphone M is the direction (the lower side of FIG. 1) opposite to the upper side of the microphone M.

The microphone case 1 accommodates the ribbon microphone unit 2 and the condenser microphone unit 3. The microphone case 1 is composed of metal and has a shape of a hollow cylinder with a bottom end.

The microphone case 1 includes two first windows 11*h*, two second windows (not shown), and a mesh 12. The first windows 11*h* and the second windows have rectangular shapes. The first windows 11*h* are disposed on the front face of the circumferential wall of the microphone case 1 and adjacent to each other along the longitudinal direction (the vertical direction in FIG. 1) of the microphone case 1. The second windows are disposed on the rear face of the circumferential wall of the microphone case 1 and adjacent to each other along the longitudinal direction of the microphone case 1. The second windows face the first windows 11*h*. The first windows 11*h* and the second windows face the ribbon microphone unit 2 when the ribbon microphone unit 2 is accommodated in the microphone case 1. The first windows 11*h* and the second windows are covered with the mesh 12 from the inside of the microphone case 1. The mesh 12 prevents intrusion of foreign objects into the microphone case 1.

Figure 3:
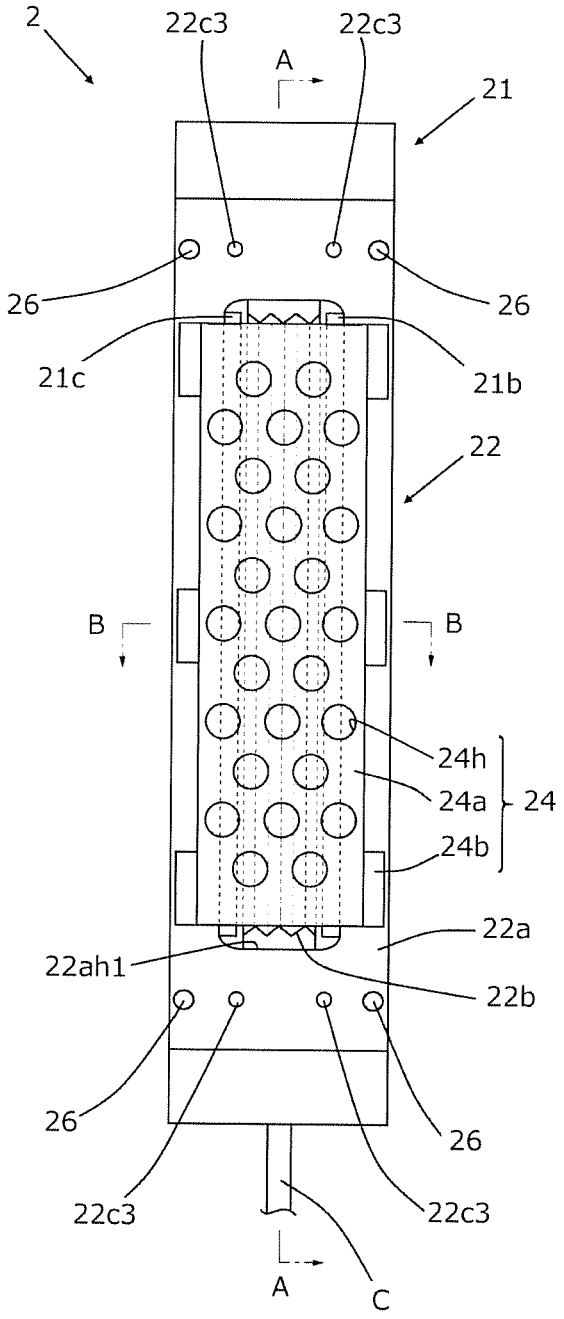
FIG. 3 is a front view of a microphone unit of the microphone in FIG. 1.

FIG. 3 is a front view of the ribbon microphone unit 2.

Figure 4:
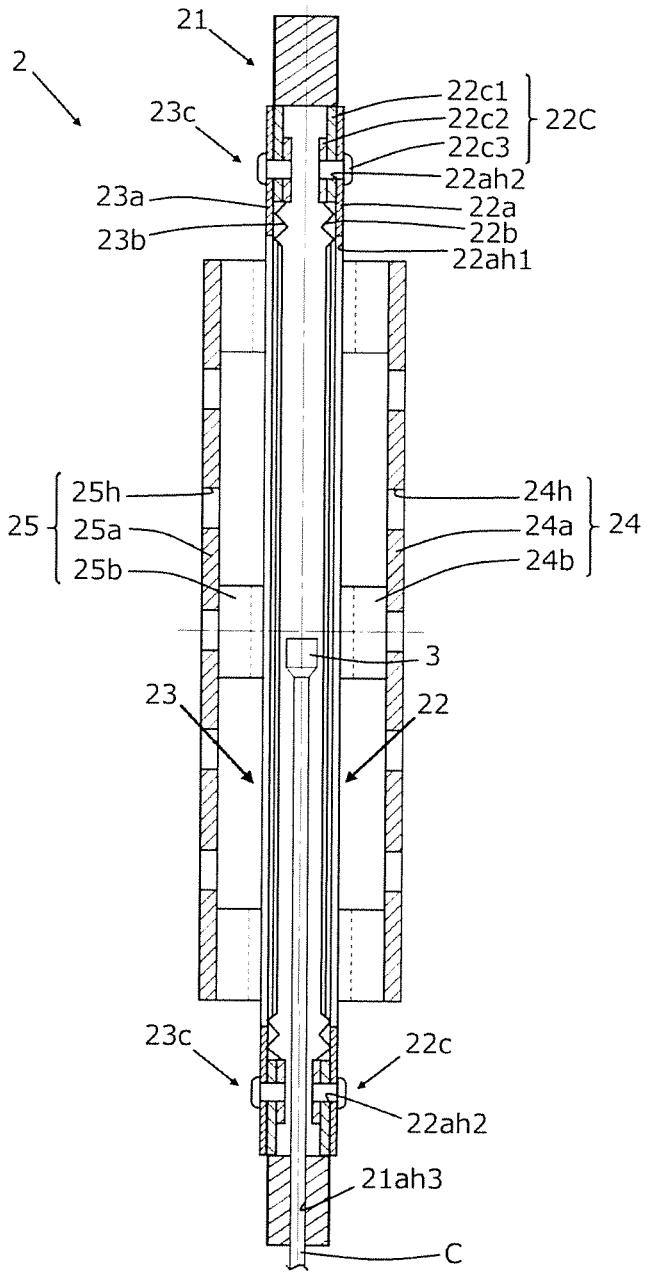
FIG. 4 is a cross-sectional view of the microphone unit taken along line A-A of FIG. 3.

FIG. 4 is a cross-sectional view of the ribbon microphone unit 2 taken along line A-A of FIG. 3.

The ribbon microphone unit 2 collects acoustic waves from the sound source and outputs electrical signals corresponding to the acoustic waves. The ribbon microphone unit 2 has bidirectivity. The ribbon microphone unit 2 includes a magnetic circuit assembly 21, a first diaphragm assembly 22, a second diaphragm assembly 23, a first protective plate 24, a second protective plate 25, and screws 26.

Figure 5:
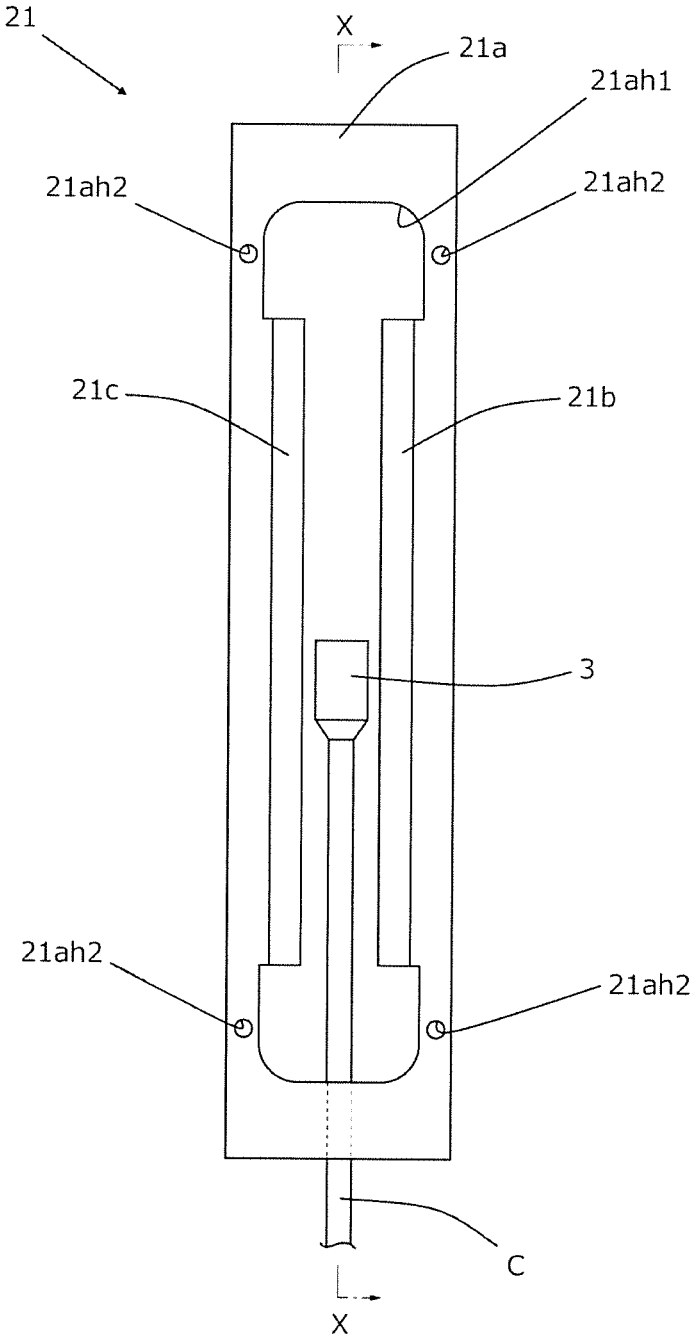
FIG. 5 is a front view of a magnetic circuit assembly of the microphone unit in FIG. 3.

FIG. 5 is a front view of the magnetic circuit assembly 21.

Figure 6:
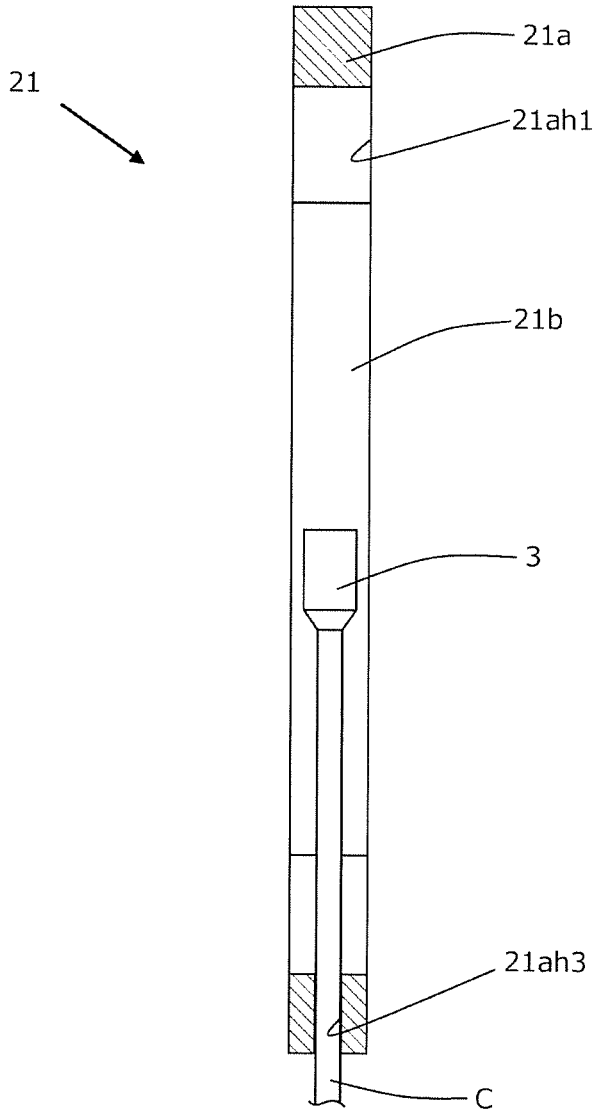
FIG. 6 is a cross-sectional view of the magnetic circuit assembly taken along line X-X of FIG. 5.

FIG. 6 is a cross-sectional view of the magnetic circuit assembly 21 taken along line X-X of FIG. 6.

FIGS. 5 and 6 also illustrate the condenser microphone unit 3 inside the magnetic circuit assembly 21.

The magnetic circuit assembly 21 generates a magnetic flux inside the magnetic circuit assembly 21 and fixes the condenser microphone unit 3. The magnetic circuit assembly 21 includes a yoke 21*a*, a first magnet 21*b*, and a second magnet 21*c*.

The yoke 21*a* is composed of magnetic material, such as iron. The yoke 21*a* has a substantially rectangular shape. The yoke 21*a* has a window 21*ah*1 having a substantially rectangular shape. The window 21*ah*1 is disposed in the central area in the width direction (the horizontal direction in FIG. 5) of the yoke 21*a*. The window 21*ah*1 penetrates in the thickness direction (the forward-backward direction in FIG. 5) of the yoke 21*a*. The window 21*ah*1 defines a magnetic gap, which is described below, and accommodates ribbon diaphragms 22*b* and 23*b*, which are described below.

The yoke 21*a* has four screw holes 21*ah*2. The screw holes 21*ah*2 are the holes into which the screws 26 are to be screwed (see FIG. 3). Two of the screw holes 21*ah*2 are disposed in the upper portion of the yoke 21*a* symmetrically about the central line in the width direction of the yoke 21*a* (hereinafter referred to as "central line"). The other two screw holes 21*ah*2 are disposed in the lower portion of the yoke 21*a* symmetrically about the central line.

The yoke 21*a* has an insertion hole 21*ah*3 penetrating in the vertical direction (the vertical direction in FIG. 6) at the lower end. The insertion hole 21*ah*3 will be described below.

The first magnet 21*b* is a permanent magnet, for example. The first magnet 21*b* has a shape of a long, thin rectangular column. The configuration of the second magnet 21*c* is identical to that of the first magnet 21*b*. The first magnet 21*b* is fixed to the inner circumferential surface of the window 21*ah*1, along the longitudinal direction of the window 21*ah*1 (the vertical direction in FIG. 5). The second magnet 21*c* is fixed to the inner circumferential surface of the window 21*ah*1, along the longitudinal direction of the window 21*ah*1 and faces the first magnet 21*b*. A gap is formed between the first magnet 21*b* and the second magnet 21*c*.

The magnetic pole of the face of the first magnet 21*b* facing the second magnet 21*c* is different from that of the face of the second magnet 21*c* facing the first magnet 21*b*. Thus, the magnetic fluxes generated from the first magnet 21*b* and the second magnet 21*c* pass through the gap. That is, the magnetic circuit assembly 21 includes a magnetic gap.

As shown in FIGS. 3 and 4, the first diaphragm assembly 22 includes a board 22*a*, a ribbon diaphragm 22*b*, and fixing portions 22*c*.

The board 22*a* is composed of light metal, such as aluminum. The board 22*a* has a rectangular shape. The board 22*a* has a window 22*ah*1, four first screw insertion holes (not shown), and four second screw insertion holes 22*ah*2 (only two of which is shown). The window 22*ah*1 is disposed in the central area of the board 22*a*. The window 22*ah*1 has a shape of a rectangle having the long sides along the longitudinal direction of the board 22*a* (the vertical direction in FIG. 3). The first screw insertion holes are disposed at the four corners of the board 22*a*. The first screw insertion holes are the holes into which the screws 26 are to be inserted.

Two of the second screw insertion holes 22*ah*2 are disposed between two of the first screw insertion holes adjacent to each other along the width direction of the board 22*a* (the horizontal direction in FIG. 3). That is, the board 22*a* has two of the second insertion holes 22*ah*2 in the upper portion, and the other two second insertion holes 22*ah*2 in the lower portion. The second insertion holes 22*ah*2 are the holes into which screws 22*c*3, which are described below, are inserted.

The ribbon diaphragm 22*b* is configured to vibrate in response to acoustic waves from the sound source and outputs electrical signals corresponding to the vibration. The ribbon diaphragm 22*b* is composed of metal, such as aluminum foil. The entire ribbon diaphragm 22*b* other than both ends in the vertical direction of the ribbon diaphragm 22*b* (the vertical direction in FIG. 3) is folded along the vertical direction into a bellows pattern. The length of the ribbon diaphragm 22*b* in the width direction (the horizontal direction in FIG. 3) is shorter than the length of the window 22*ah*1 in the width direction (the horizontal direction in FIG. 3).

The fixing portions 22*c* fix the ribbon diaphragm 22*b* to the board 22*a*. The fixing portions 22*c* each include a spacer 22*c*1, a metal fitting 22*c*2, and a screw 22*c*3. The spacers 22*c*1 and the metal fittings 22*c*2 are attached to the upper and lower portions of the board 22*a* with the screws 22*c*3 inserted into the second insertion holes 22*ah*2. The spacers 22*c*1 and the metal fittings 22*c*2 fixed to the board 22*a* hold the upper and lower ends of the ribbon diaphragm 22*b* therebetween. That is, the ribbon diaphragm 22*b* is fixed to the board 22*a* with the fixing portions 22*c*.

The second diaphragm assembly 23 includes a board 23*a*, a ribbon diaphragm 23*b*, and fixing portions 23*c*. The configuration of the second diaphragm assembly 23 is identical to that of the first diaphragm assembly 22. That is, the ribbon diaphragm 23*b* is fixed to the board 23*a* with the fixing portions 23*c*.

The first diaphragm assembly 22 is attached to the front face (the face on the right in FIG. 4) of the magnetic circuit assembly 21 with the screws 26. The screws 26 are inserted into the first screw insertion holes of the first diaphragm assembly 22 and are screwed into the screw holes 21*ah*2 of the magnetic circuit assembly 21 (see FIG. 5). The first diaphragm assembly 22 covers the window 21*ah*1 in the magnetic circuit assembly 21 from the front of the magnetic circuit assembly 21. As shown in FIG. 4, the ribbon diaphragm 22*b* is accommodated in the window 21*ah*1. As a result, the portion of the ribbon diaphragm 22*b* folded into a bellow pattern is disposed in the magnetic gap of the magnetic circuit assembly 21.

The second diaphragm assembly 23 is attached to the rear face (the face on the left in FIG. 4) of the magnetic circuit assembly 21 in a manner similar to that of the first diaphragm assembly 22. The ribbon diaphragm 23*b* is accommodated in the window 21*ah*1 of the magnetic circuit assembly 21. As a result, the portion of the ribbon diaphragm 23*b* folded into a bellow pattern and disposed in the window 21*ah*1 is placed in the magnetic gap of the magnetic circuit assembly 21.

The first diaphragm assembly 22 and the second diaphragm assembly 23 are attached to the magnetic circuit assembly 21. The first diaphragm assembly 22 and the second diaphragm assembly 23 hold the magnetic circuit assembly 21 from the front and rear faces of the magnetic circuit assembly 21.

The first protective plate 24 protects the ribbon diaphragm 22*b* from magnetic dust, for example. The first protective plate 24 is composed of metal. The first protective plate 24 includes a body 24*a* and six legs 24*b*. The body 24*a* is a plate having a rectangular shape in front view. Three of the legs 24*b* are disposed at three positions on each side along the longitudinal direction (the vertical direction) of the body 24*a*. The legs 24*b* protrude from the body 24*a* at a right angle. The outer ends of the legs 24*b* are bent at a right angle in the outward direction (the horizontal direction in FIG. 3). The body 24*a* has multiple sound holes 24*h*. The sound holes 24*h* guide acoustic waves from the sound source to the ribbon diaphragm 22*b*. The sound holes 24*h* are disposed at a substantially equal interval in the body 24*a*.

The second protective plate 25 protects the ribbon diaphragm 23*b* from magnetic dust, for example. The second protective plate 25 includes a body 25*a* and legs 25*b*. The body 25*a* includes sound holes 25*h*. The configuration of the second protective plate 25 is identical to that of the first protective plate 24.

The first protective plate 24 is attached to the front face of the first diaphragm assembly 22. The legs 24*b* of the first protective plate 24 are attached to the board 22*a* of the first diaphragm assembly 22. The body 24*a* of the first protective plate 24 faces the ribbon diaphragm 22*b* and protects the ribbon diaphragm 22*b*.

The second protective plate 25 is attached to the rear face of the second diaphragm assembly 23. The legs 25*b* of the second protective plate 25 are attached to the board 23*a* of the second diaphragm assembly 23. The body 25*a* of the second protective plate 25 faces the ribbon diaphragm 23*b* and protects the ribbon diaphragm 23*b*.

The condenser microphone unit 3 collects acoustic waves from the sound source. The condenser microphone unit 3 has omnidirectivity. The condenser microphone unit 3 has a columnar outer shape. The condenser microphone unit 3 has sound holes (not shown) in the upper end face. The sound holes guide acoustic waves from the sound source into the condenser microphone unit 3. The condenser microphone unit 3 is connected to a connector (not shown) with a cable C. The cable C is inserted into the insertion hole 21*ah*3 of the magnetic circuit assembly 21.

Figure 7:
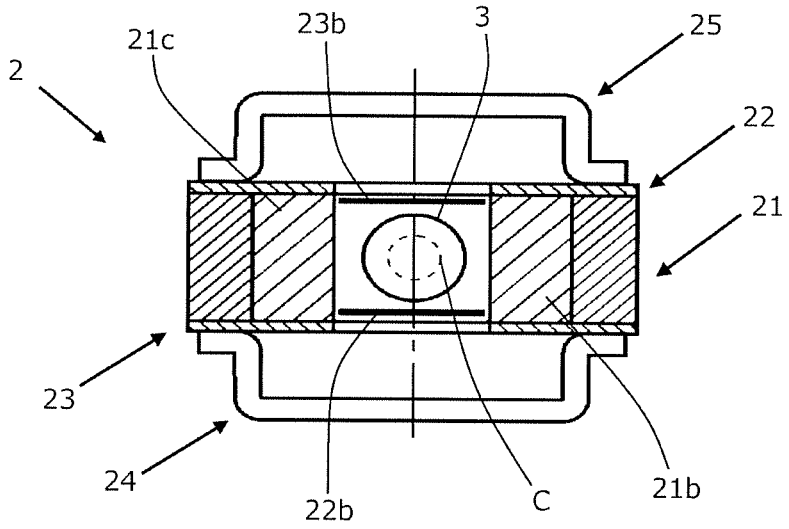
FIG. 7 is a cross-sectional view of the microphone unit taken long line B-B of FIG. 3.

FIG. 7 is a cross-sectional view of the ribbon microphone unit 2 taken along line B-B of FIG. 3.

The condenser microphone unit 3 is disposed inside the ribbon microphone unit 2 between the pair of the ribbon diaphragm 22*b* and the ribbon diaphragm 23*b*. The condenser microphone unit 3 is disposed between the pair of the first magnet 21*b* and the second magnet 21*c*. That is, the condenser microphone unit 3 is surrounded by the pair of the ribbon diaphragm 22*b* and the ribbon diaphragm 23*b* and the pair of the first magnet 21*b* and the second magnet 21*c* in the magnetic gap of the magnetic circuit assembly 21. In other words, the condenser microphone unit 3 is disposed inside the yoke 21*a*.

The condenser microphone unit 3 is disposed at a position equally distant from the pair of the ribbon diaphragm 22*b* and the ribbon diaphragm 23*b*. As shown in FIG. 4, the upper end face of the condenser microphone unit 3 is disposed below the center in the longitudinal direction of the pair of the ribbon diaphragm 22*b* and the ribbon diaphragm 23*b* (the dash-dot line along the horizontal direction in FIG. 4).

Acoustic Terminal

An acoustic terminal of the ribbon microphone unit 2 and an acoustic terminal of the condenser microphone unit 3 will now be described with reference to FIG. 4.

The acoustic terminal of the ribbon microphone unit 2 is the position of the air applying sound pressure effectively to the ribbon microphone unit 2. In other words, the acoustic terminal of the ribbon microphone unit 2 is the central position of the air flowing in response to the movement of the ribbon diaphragm 22*b* (ribbon diaphragm 23*b*) of the ribbon microphone unit 2. That is, the acoustic terminal of the ribbon microphone unit 2 is the acoustic center of the ribbon microphone unit 2.

Since the ribbon microphone unit 2 has bidirectivity, the ribbon microphone unit 2 has two acoustic terminals. One of the two acoustic terminals of the ribbon microphone unit 2 resides at the center in the longitudinal direction of the ribbon diaphragm 22*b* and in the proximity of the sound holes 24*h* of the first protective plate 24 in the front of the first protective plate 24. The other acoustic terminal resides at the center in the longitudinal direction of the ribbon diaphragm 23*b* and in the proximity of the sound holes 25*h* of the second protective plate 25 in the rear of the first protective plate 24.

The acoustic terminal of the condenser microphone unit 3 is the position of the air applying sound pressure effectively to the condenser microphone unit 3. In other words, the acoustic terminal of the condenser microphone unit 3 is the central position of the air flowing in response to the movement of the diaphragms of the condenser microphone unit 3. That is, the acoustic terminal of the condenser microphone unit 3 is the acoustic center of the condenser microphone unit 3.

Since the condenser microphone unit 3 has omnidirectivity, the condenser microphone unit 3 has one acoustic terminal. The acoustic terminal of the condenser microphone unit 3 resides in the proximity of the sound holes of the condenser microphone unit 3 in the upper side of the condenser microphone unit 3.

The condenser microphone unit 3 is disposed inside the ribbon microphone unit 2 such that the acoustic terminal of the condenser microphone unit 3 resides coaxially within with the two acoustic terminals of the ribbon microphone unit 2. As a result, the acoustic terminal of the condenser microphone unit 3 resides in the proximity of two acoustic terminals of the ribbon microphone unit 2, in the same plane. That is, the condenser microphone unit 3 is disposed inside the ribbon microphone unit 2 such that the acoustic terminal of the condenser microphone unit 3 resides coaxially within and in the proximity of the acoustic terminals of the ribbon microphone unit 2, in the same plane.

The acoustic terminal of the condenser microphone unit 3 disposed inside the ribbon microphone unit 2 resides coaxially within and in the proximity of the acoustic terminals of the ribbon microphone unit 2, in the same plane. That is, the ribbon microphone unit 2 and the condenser microphone unit 3 receive acoustic waves having the same sound pressure. The condenser microphone unit 3 and the ribbon microphone unit 2 collect the same acoustic waves. The electrical signals output from the condenser microphone unit 3 are added to the electrical signals output from the ribbon microphone unit 2. That is, the omnidirectional component of the omnidirectional condenser microphone unit 3 is added to the bidirectional component of the bidirectional ribbon microphone unit 2. In other words, the microphone M has unidirectivity.

The condenser microphone unit 3 should be disposed inside the ribbon microphone unit 2 such that the condenser microphone unit 3 and the ribbon microphone unit 2 receive acoustic waves having the same sound pressure. That is, for example, the upper end face of the condenser microphone unit 3 may be disposed on the axis connecting the two acoustic terminals of the ribbon microphone unit 2. In other words, the upper end face of the condenser microphone unit 3 may be disposed at the center in the longitudinal direction of the pair of the ribbon diaphragm 22*b* and the ribbon diaphragm 23*b*.

CONCLUSION

According to the embodiment described above, the condenser microphone unit 3 is disposed inside the ribbon microphone unit 2. The acoustic terminal of the omnidirectional condenser microphone unit 3 resides coaxially within and in the proximity of the acoustic terminals of the bidirectional ribbon microphone unit 2, in the same plane. That is, the microphone M has unidirectivity as a result of addition of the bidirectional component of the ribbon microphone unit 2 and the omnidirectional component of the condenser microphone unit 3. In this way, the unidirectivity of the microphone M is achieved through a simple combination of the bidirectional ribbon microphone unit 2 and the omnidirectional condenser microphone unit 3. In the microphone M, the condenser microphone unit 3 is disposed inside the ribbon microphone unit 2. Thus, the microphone M has reduced dimensions.

The invention claimed is:

1. A microphone having unidirectivity, comprising:
a bidirectional ribbon microphone unit; and
an omnidirectional condenser microphone unit, wherein,
the ribbon microphone unit includes a pair of ribbon diaphragms, and
the condenser microphone unit is positioned in a magnetic gap of the ribbon microphone unit and between the pair of ribbon diaphragms.

2. The microphone according to claim 1, wherein the ribbon microphone unit has an acoustic terminal in the same plane with an acoustic terminal of the condenser microphone unit.

3. The microphone according to claim 1, further comprising:
a magnetic circuit assembly providing the magnetic gap, wherein,
the magnetic circuit assembly comprises:
a yoke having a window; and
a magnet fixed in the window,
the pair of ribbon diaphragms are disposed in the magnetic gap, and
the condenser microphone unit is disposed in the yoke.

4. The microphone according to claim 3, wherein the condenser microphone unit is disposed at a position equally distant from the pair of ribbon diaphragms.

5. The microphone according to claim 1, wherein an electrical signal output from the ribbon microphone unit is added to an electrical signal output from the condenser microphone unit.

* * * * *